US005637032A

United States Patent [19]

Thysell et al.

[11] Patent Number: 5,637,032

[45] Date of Patent: Jun. 10, 1997

[54] ROTARY DISC PLANETARY TYPE SURFACING MACHINE

[76] Inventors: Håkan Thysell, Ågatan 7 S-614 34, Söderköping; Urban Thysell, Silverringen 108 S-603 65, Norrköping, both of Sweden

[21] Appl. No.: 406,885

[22] PCT Filed: Oct. 22, 1993

[86] PCT No.: PCT/SE93/00865

§ 371 Date: Mar. 22, 1995

§ 102(e) Date: Mar. 22, 1995

[87] PCT Pub. No.: WO94/08752

PCT Pub. Date: Apr. 28, 1994

[30] Foreign Application Priority Data

Oct. 22, 1992 [SE] Sweden ..... 9203099

[51] Int. Cl.[6] ..... B24B 7/00

[52] U.S. Cl. ..... 451/259; 451/350

[58] Field of Search ..... 451/350, 259, 451/354, 360, 344, 353; 15/385, 98, 49.1

[56] References Cited

U.S. PATENT DOCUMENTS

| | | | |
|---|---|---|---|
| 1,928,390 | 9/1933 | Myers . | |
| 2,941,222 | 6/1960 | Allen et al. | 15/49.1 |
| 3,074,089 | 1/1963 | Brown, Jr. | 15/49.1 |
| 3,169,262 | 2/1965 | Allen et al. | 15/49.1 |
| 3,354,488 | 11/1967 | Blide | 15/49.1 |
| 4,097,950 | 7/1978 | Satterfield | 15/49.1 |
| 4,150,456 | 4/1979 | Alvarez et al. . | |
| 4,862,548 | 9/1989 | Sergio | 15/49.1 |

FOREIGN PATENT DOCUMENTS

| | | |
|---|---|---|
| 1115608 | 10/1961 | Germany . |
| 117264 | 9/1946 | Sweden . |

*Primary Examiner*—Bruce M. Kisliuk
*Assistant Examiner*—Derris H. Banks
*Attorney, Agent, or Firm*—Dvorak and Traub

[57] ABSTRACT

The invention relates to an arrangement for a mobile surfacing machine, preferably for the surfacing of stone floors. A frame supports a drive motor with a motor shaft. A planet disc is rotatably mounted in the fame, with three surfacing discs arranged on shafts rotatably mounted on the planet disc. The surfacing discs are in operative connection with a belt pulley arranged on the drive shaft of the motor via a drive belt running around first belt pulleys arranged on the aforementioned shafts. The shafts of the surfacing discs are so arranged, for the purpose of controlling the rotation of the planet disc, as to be in operative connection with the frame. The operative connection comprises, for example, a belt pulley attached to the frame, second belt pulleys arranged on the shafts of the surfacing discs, and a second belt running around these and the belt pulley attached to the frame.

2 Claims, 4 Drawing Sheets

ROTARY DISC PLANETARY TYPE SURFACING MACHINE

BACKGROUND OF THE INVENTION

The present invention relates to a mobile surfacing machine, preferably for the surfacing of stone floors, consisting of a frame which supports a drive motor with a motor shaft and a planet disc rotatably mounted in the frame, with three surfacing discs arranged on shafts rotatably mounted on the planet disc, which surfacing discs are operatively connected with a belt pulley arranged on the drive shaft of the motor via a drive belt running around first belt pulleys arranged on the aforementioned shafts.

In a previously disclosed surfacing machine of this kind, the planet disc has a speed which depends very largely on the degree of engagement of the surfacing discs with the floor to be surfaced. This poses considerable risks of uncontrolled movement in the surfacing machine, with an associated reduction in processing capacity and increased wear on the surfacing discs. These risks can certainly be minimized, although not entirely eliminated by an experienced surfacing machine operator.

SUMMARY OF THE INVENTION

The object of the present invention is to make available a surfacing machine of the kind referred to by way of introduction, which does not suffer from the aforementioned disadvantages, which can be handled by an operator with only brief experience of surfacing, and which has a greater processing capacity in comparison with previously disclosed surfacing machines.

This is achieved in accordance with the invention in that the shafts of the surfacing discs are so arranged, for the purpose of controlling the rotation of the planet disc, as to be in operative connection with the frame.

BRIEF DESCRIPTION OF THE DRAWINGS

The invention is explained in greater detail below with reference to the accompanying drawing, in which.

According to one particular characteristic of the invention, the operative connection comprises, as an alternative to the combination of belt pulleys and belts, an internal cylindrical contact surface attached to the frame for wheels arranged on the shafts of the surfacing discs.

DESCCRIPTION OF THE EMBODIMENTS

In accordance with a preferred embodiment, the aforementioned operative connection comprises a belt pulley attached to the frame, second belt pulleys arranged on the shafts of the surfacing discs, and a second belt running around these and the belt pulley attached to the frame. The combination of belt pulleys and belts imparts a certain extensibility to the operative connection, which is positive in this context.

According to one particular characteristic of the invention, the operative connection comprises, as an alternative to the combination of belt pulleys and belts, an internal cylindrical contact surface attached to the frame for wheels arranged on the shafts of the surfacing discs.

Figure 1:
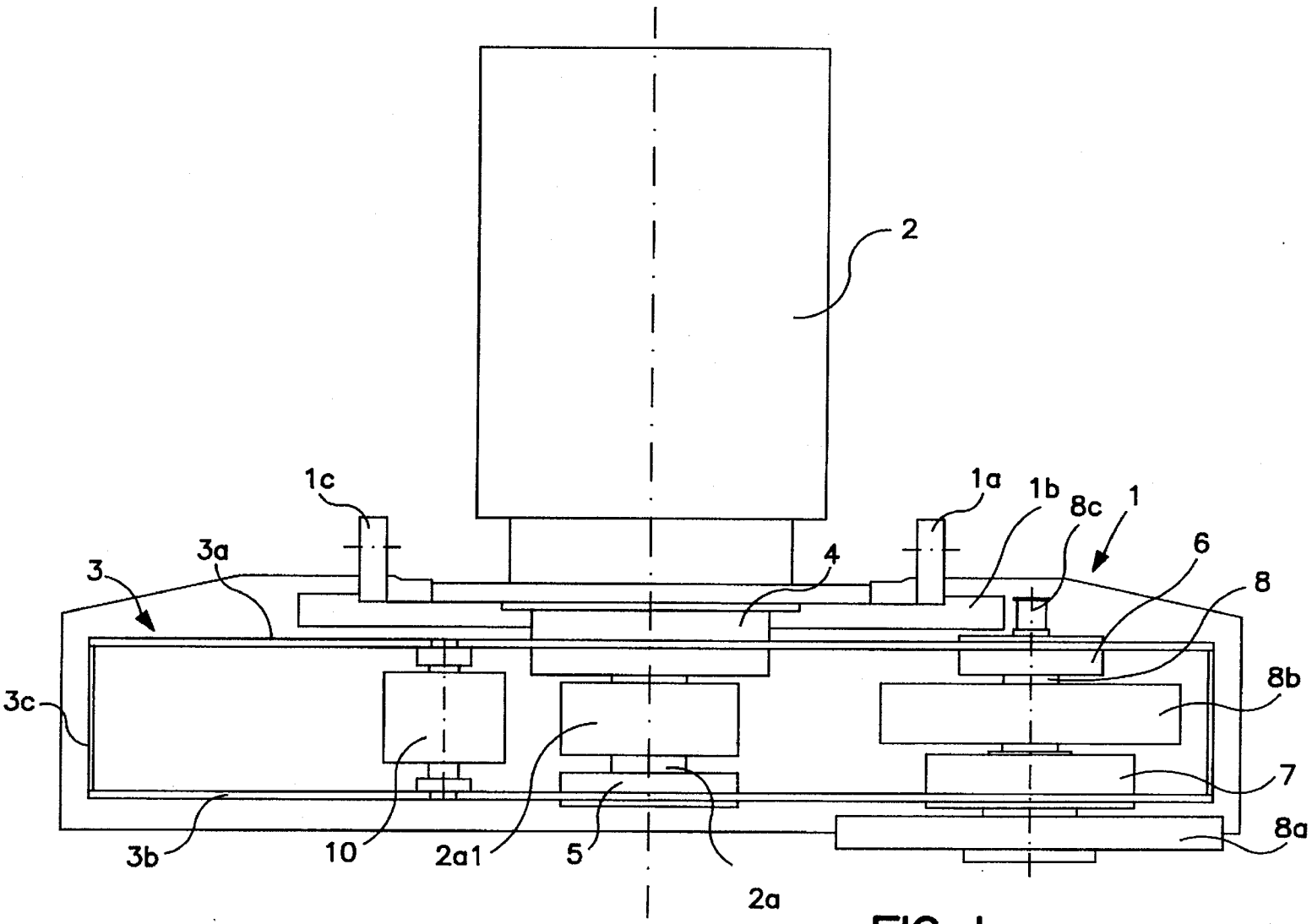
FIG. 1 illustrates in schematic form a section through an illustrative embodiment of a surfacing machine in accordance with the invention.
Figure 2A:
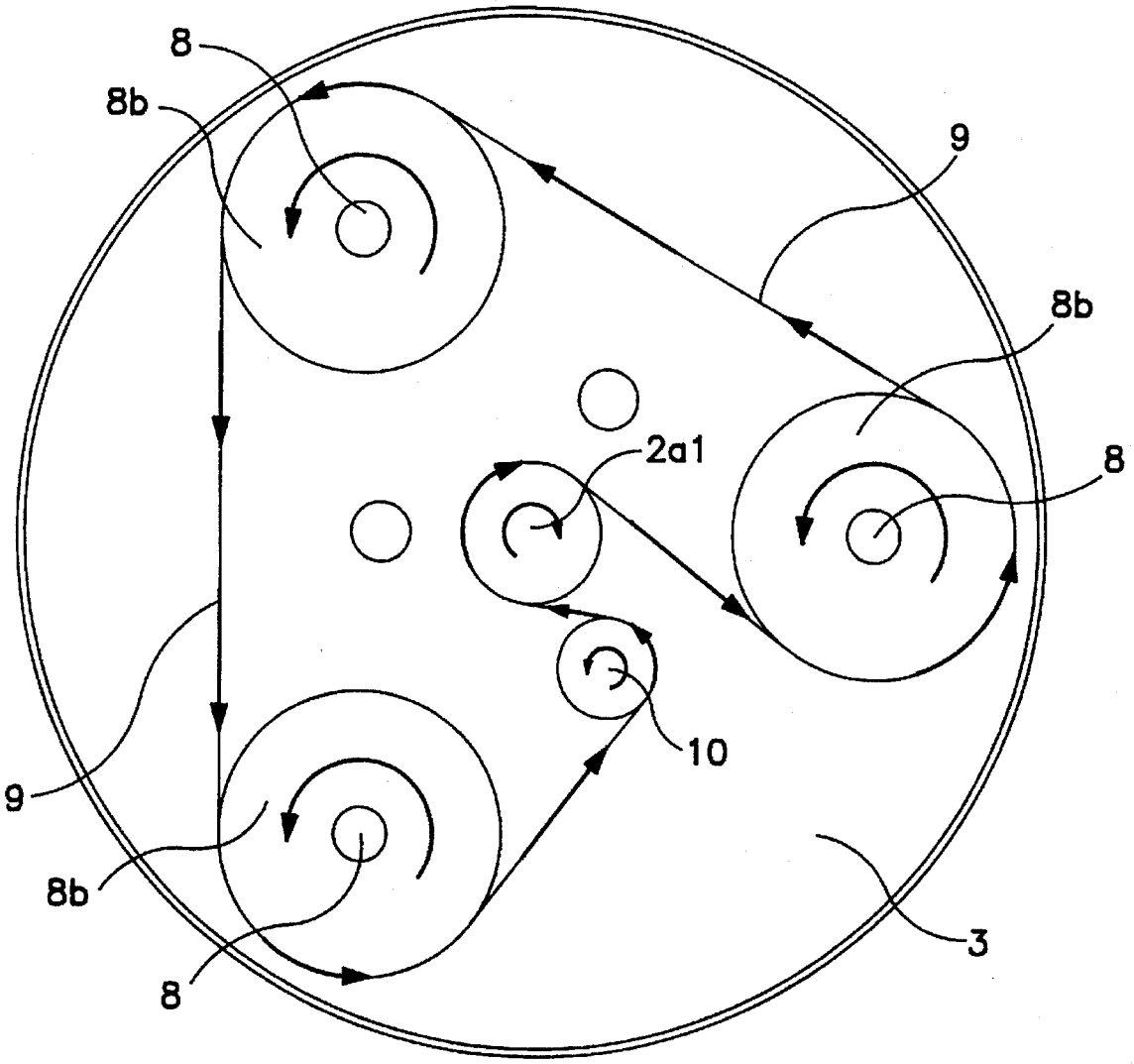
FIGS. 2*a* and 2*b* show respectively plan views of what is in itself a conventional drive for the surfacing discs of the surfacing machine in accordance with FIG. 1 and an embodiment of an operative connection in accordance with the invention between the frame of the surfacing machine and the shafts of the surfacing discs.
Figure 2B:
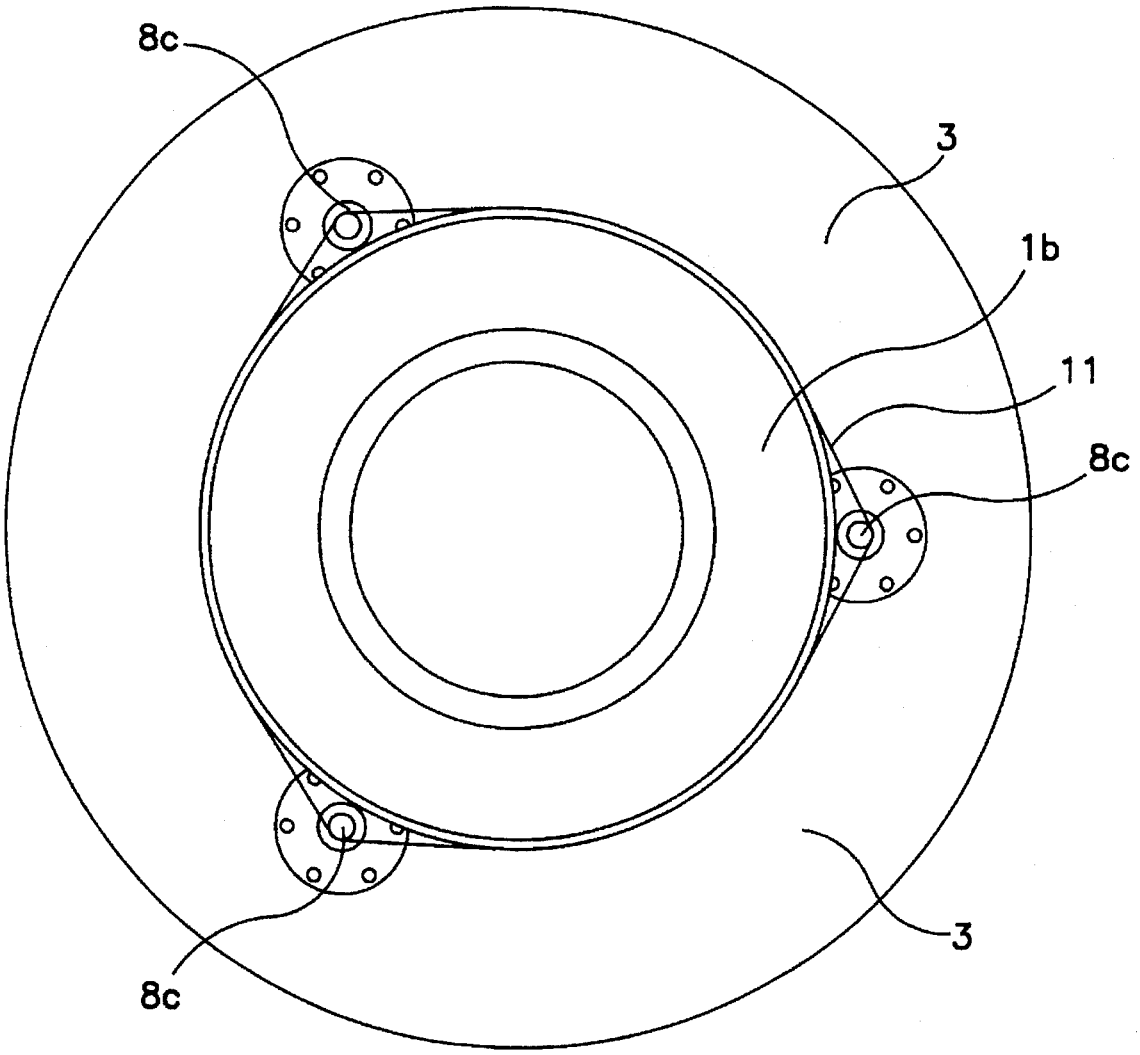
Figure 3:
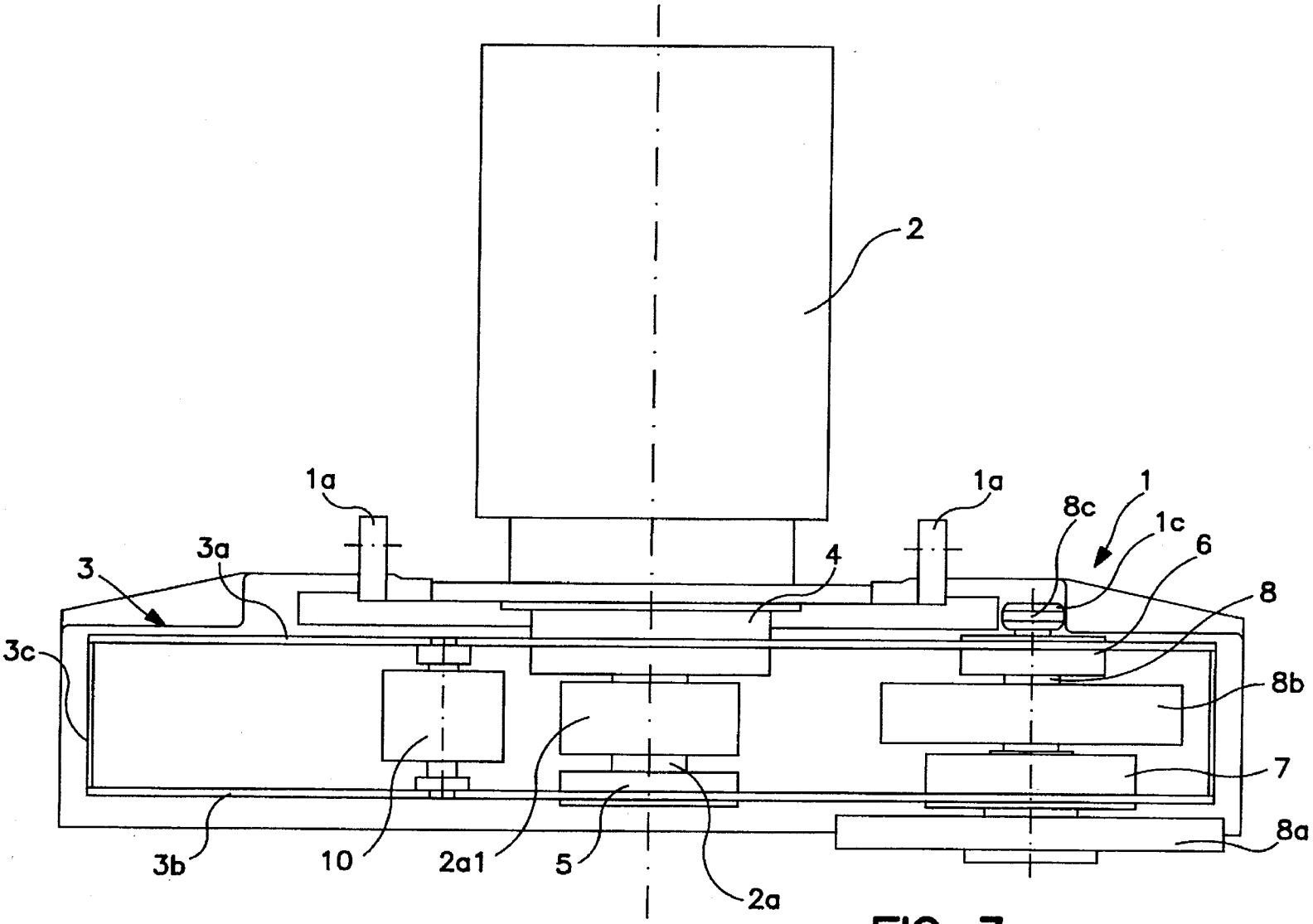
FIG. 3 shows in a section, similar to that in FIG. 1, an alternative embodiment of the aforementioned operative connection.

The invention is explained in greater detail below with reference to the accompanying drawing, in which FIG. 1 illustrates in schematic form a section through an illustrative embodiment of a surfacing machine in accordance with the invention. FIGS. 2*a* and 2*b* show respectively plan views of what is in itself a conventional drive for the surfacing discs of the surfacing machine in accordance with FIG. 1 and an embodiment of an operative connection in accordance with the invention between the frame of the surfacing machine and the shafts of the surfacing discs. FIG. 3 shows in a section, similar to that in FIG. 1, an alternative embodiment of the aforementioned operative connection.

The reference numeral I is used in the drawings to designate a frame for a mobile surfacing machine, the frame is provided with attachment ears Ia for control devices not shown in the drawing, by means of which a machine operator can move the machine over a floor that is to be surfaced. The frame 1 supports a drive motor 2 and a planet disc 3 rotatably mounted in the frame 1. The planet disc 3 has the form of a flat cylindrical container with an upper end 3*a* and a lower end 3*b* connected together by means of a cylindrical wall. The rotatable mounting of the planet disc 3 in the frame 1 is achieved by means of a rotary bearing 4 arranged in the upper end 3a and in the frame 1. The motor 2 has a shaft 2*a* provided with a belt pulley 2*al*, which shaft is connected at its outer end to the lower end 3*b* of the planet disc 3 by means of a rotary bearing 5. This mounting between the frame 1, the motor 2 and the planet disc 3 gives a highly robust construction while concurrently affording good protection between the ends 3*a*, 3*c* and between the frame 1 and the upper end 3*a* to the components described below.

Rotatably mounted in the planet disc 3 by means of bearing 6, 7 are three shafts 8, each of which is equipped with a surfacing disc 8*a* at one end, and with a belt pulley 8*b* between the bearings. A drive belt 9, by means of which the motor 2 causes the surfacing discs 8*a* to rotate, runs around the belt pulley 2*al* and the three belt pulleys 8*b*, as can be readily appreciated from FIG. 2*a*. The belt 9 also runs over a tensioner pulley 10 arranged between the ends 3*a*, 3*b* and rotatably mounted therein. The tensioner pulley is arranged so as to contribute to the belt 9 wrapping around the largest possible part of the circumference of the belt pulley 2*al*, in order to achieve good power transmission between the belt 9 and the belt pulley 2*al*.

In accordance with the invention, an operative connection is present between the respective shaft 8 and the frame 1 for controlling the rotation of the planet disc. In the embodiment illustrated in FIGS. 1 and 2*b*, this operative connection comprises a belt pulley 1*b* attached to the frame 1, belt pulleys 8*c* attached to the other free ends 8 of the shafts 8, and a belt 11 running over the aforementioned belt pulleys 8*c*, 1*b*. The gear ratio between the operative connections of the surfacing discs 8*a* and the frame 1 should be of the order of 1:15–1:30.

It is obvious that the operative connection between the frame 1 and the surfacing discs 8*a* can be executed in many ways within the scope of the idea of invention. Such an alternative design of operative connection is illustrated in FIG. 3, where components which correspond to FIG. 1 have been allocated unchanged reference designations. This comprises wheels 8*c* arranged on the free ends of the shafts 8, which wheels are in engagement with an internal contact surface 1*c* attached to the frame.

We claim:

1. An arrangement for a mobile surfacing machine provided with a frame supporting a drive motor having a drive shaft, a planet disc rotatably mounted in the frame, a first, second, and third surfacing disc arranged on a corresponding first, second, and third shafts rotatably mounted on the planet disc, and a first operative connection of the first, second, and third surfacing discs with the drive shaft of the motor via a drive belt arranged to run around a drive shaft belt pulley arranged on the drive shaft and over a first, second, and third shaft belt pulleys arranged on the corresponding first, second, and third shafts, comprising: a second operative connection for the purpose of controlling the rotation of the planet disc via a belt arranged to run around a frame belt pulley attached to the frame and over a first second, and third planet belt pulleys arranged on the respective shafts of the surfacing discs wherein the first and the second operative connections impart mutually opposing directions of rotation to the planet disc and the surfacing discs.

2. The arrangement in accordance with claim 1, further comprising a gear ratio between the second operative connection between the shafts of the surfacing discs and the frame of from 1:15 to 1:30.

* * * * *